US010087931B2

(12) United States Patent
Hayes-Pankhurst

(10) Patent No.: US 10,087,931 B2
(45) Date of Patent: Oct. 2, 2018

(54) PUMPS

(71) Applicant: QUANTEX PATENTS LIMITED, London (GB)

(72) Inventor: Richard Paul Hayes-Pankhurst, London (GB)

(73) Assignee: QUANTEX PATENTS LIMITED, London (GB)

( * ) Notice: Subject to any disclaimer, the term of this patent is extended or adjusted under 35 U.S.C. 154(b) by 387 days.

(21) Appl. No.: 14/377,384

(22) PCT Filed: Jan. 31, 2013

(86) PCT No.: PCT/EP2013/051953
§ 371 (c)(1),
(2) Date: Aug. 7, 2014

(87) PCT Pub. No.: WO2013/117486
PCT Pub. Date: Aug. 15, 2013

(65) Prior Publication Data

US 2016/0010643 A1 Jan. 14, 2016

(30) Foreign Application Priority Data

Feb. 9, 2012 (GB) ..... 1202255.4

(51) Int. Cl.
*F01C 19/02* (2006.01)
*F01C 19/06* (2006.01)
(Continued)

(52) U.S. Cl.
CPC ..... *F04C 15/0015* (2013.01); *F01C 1/3566* (2013.01); *F01C 5/04* (2013.01);
(Continued)

(58) Field of Classification Search
CPC ..... F01C 5/04; F04C 15/0015; F04C 5/00
(Continued)

(56) References Cited

U.S. PATENT DOCUMENTS 782,037 A * 2/1905 Lee ..... F04C 2/102 418/125
2,050,473 A * 8/1936 Steinmann ..... F01C 21/08 418/139
3,400,940 A * 9/1968 Conrad ..... F16J 15/441 277/345
4,017,208 A 4/1977 Vonnegut
(Continued)

FOREIGN PATENT DOCUMENTS

JP 60 240890 11/1985
JP 61 065286 5/1986

OTHER PUBLICATIONS

International Transmittal of International Preliminary Report on Patentability, for International Application No. PCT/EP2013/051953, dated Aug. 21, 2014.
(Continued)

*Primary Examiner* — Deming Wan
(74) *Attorney, Agent, or Firm* — B. Aaron Schulman, Esq.; Nicholas Trenkle, Esq.; Stites & Harbison, PLLC

(57) ABSTRACT

A pump is formed by a housing (10) having a fluid inlet (11) and a fluid outlet (12) and containing a rotor (15) forming with the housing (10) chambers (17*a*, 17*b*) that, on rotation of the rotor (15) by a drive, convey fluid from the inlet (11) to the outlet (12) to pump the fluid. A seal assembly (14) is arranged between the outlet (12) and the inlet (11). The seal assembly (14) includes a membrane (21) that contacts the rotor (15) and a flexible resilient spring member (22, 28, 35, 37, 40) that provides a force urging the membrane (21) against the rotor (15). The spring member (22, 28, 35, 37, 40) thus, on rotation of the rotor (15), moves radially relative to the axis of rotation of the rotor (15) and is arranged to provide a force on the rotor (15) via the membrane (21) that is constant and a minimum to maintain a seal between the rotor (15) and the seal (14) for a given outlet pressure of the pumped fluid.

14 Claims, 8 Drawing Sheets

Figure 1:
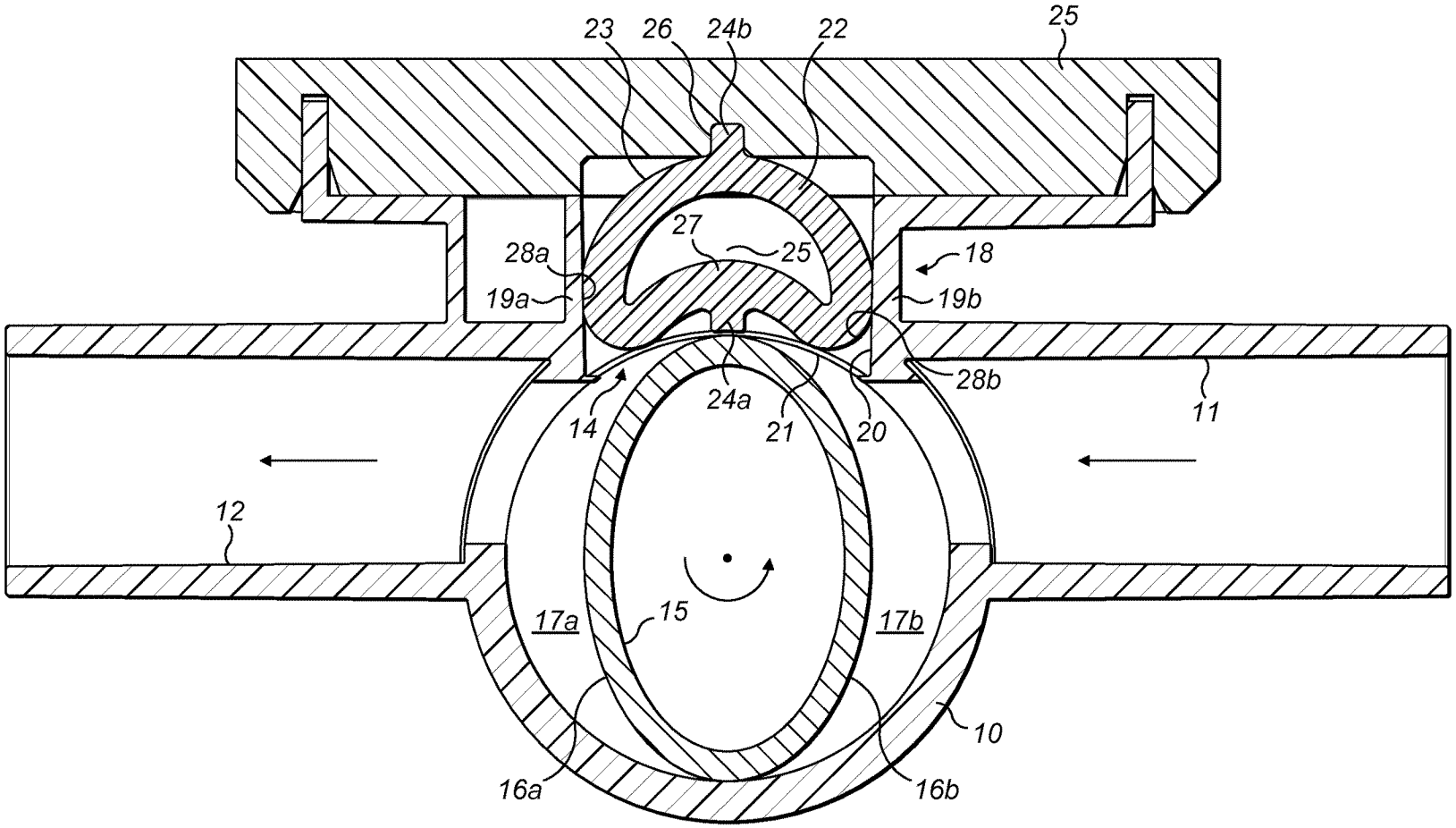

(51) Int. Cl.

| | |
|---|---|
| ***F04C 15/06*** | (2006.01) |
| ***F01C 19/10*** | (2006.01) |
| ***F04C 15/00*** | (2006.01) |
| ***F01C 1/356*** | (2006.01) |
| ***F01C 5/04*** | (2006.01) |
| ***F04C 2/356*** | (2006.01) |
| ***F04C 5/00*** | (2006.01) |

(52) U.S. Cl.
CPC ..... *F04C 2/356* (2013.01); *F04C 2/3566* (2013.01); *F04C 5/00* (2013.01)

(58) Field of Classification Search
USPC ..... 418/139, 112, 125
See application file for complete search history.

(56) References Cited

U.S. PATENT DOCUMENTS

| | | | | |
|---|---|---|---|---|
| 4,086,042 | A * | 4/1978 | Young | F04C 18/3566 418/139 |
| 7,674,100 | B2 * | 3/2010 | Hayes-Pankhurst | A61M 5/14232 418/125 |
| 2012/0034122 | A1 | 2/2012 | Hayes-Pankhurst et al. | |

OTHER PUBLICATIONS

International Search Report for PCT/EP2013/051953 dated Mar. 15, 2013.
Written Opinion of the International Searching Authority for PCT/EP2013/051953 dated Mar. 15, 2013.

* cited by examiner

PUMPS

The invention relates to pumps.

It is known from PCT/GB05/003300 and PCT/GB10/000798 to provide a pump formed by a housing having a fluid inlet and a fluid outlet and containing a rotor forming with the housing chambers that, on rotation of the rotor by a drive, convey fluid from the inlet to the outlet to pump the fluid. It is necessary to ensure that fluid cannot pass from the outlet to the inlet, in the direction of rotation of the rotor. For this purpose, PCT/GB05/003300 and PCT/GB10/000798 disclose the use of a seal arranged between the outlet and the inlet that contacts the rotor for this purpose.

Since the rotor has chamber-forming surfaces that are radially inwardly of the housing, it is necessary for the seal to move radially inwardly and outwardly relative to the axis of rotation of the rotor in order to maintain contact between the seal and those rotor surfaces to prevent the passage of fluid from the inlet to the outlet. This contact produces a frictional force that must be overcome by the rotor drive.

PCT/GB05/003300 and PCT/GB10/000798 disclose various arrangements of seal that meet this requirement such as a resilient block of material or a membrane that is resiliently supported. In all of these arrangements, the force applied to the rotor by the seal increases linearly or substantially linearly with the distance of the contact between the seal and the rotor from the common rotor/housing axis. As a result, the drive must provide sufficient torque to overcome the maximum frictional force between these parts, which is when the seal is at a maximum distance from the common axis. In addition, the force provided by the seal must be sufficient to prevent leakage between the seal and the rotor when the seal is a minimum distance from the common axis and where the frictional force is a minimum and the minimum force determines the maximum force in a linear relationship. Such a linear relationship will mean that, although the minimum force will be just sufficient to provide a seal at a given outlet pressure, the maximum force will be greatly in excess of the required force for a seal at the same outlet pressure. Increased friction also increases the heat generated between the housing and the rotor as the rotor rotates and this can be disadvantageous, particularly where the parts are of a plastics material. The generation of such heat is also disadvantageous in medical applications and such heat can be transferred to the fluid being pumped and this can affect the characteristics of the pumped fluid. Further, wear between the parts increases with increased friction.

According to the invention, there is provided a pump formed by a housing having a fluid inlet and a fluid outlet and containing a rotor forming with the housing chambers that, on rotation of the rotor by a drive, convey fluid from the inlet to the outlet to pump the fluid to the outlet at an outlet pressure, a seal being arranged between the outlet and the inlet and, on rotation of the rotor, moving radially relative to the axis of rotation of the rotor to contact the rotor to prevent fluid passing from the outlet to the inlet in the direction of rotation of the rotor, the force applied by the seal per unit distance of movement being constant (as herein defined) over the travel of the seal to minimise the force applied by the seal to the rotor for a given output pressure.

The requirement that the force applied by the seal per unit distance of travel is constant over the travel of the seal is to be taken as requiring such force per unit travel not to vary by more than ±10% over said travel In this way, the peak frictional force applied by the seal to the rotor is reduced as compared to known proposals for any given outlet pressure and so the torque required from the drive can be reduced. This can also allow more accurate speed control of the drive and reduction in the wear between parts and the heat generated.

The following is a more detailed description of some embodiments of the invention, by way of example, reference being made to the accompanying drawings, in which:—

Figure 2A:
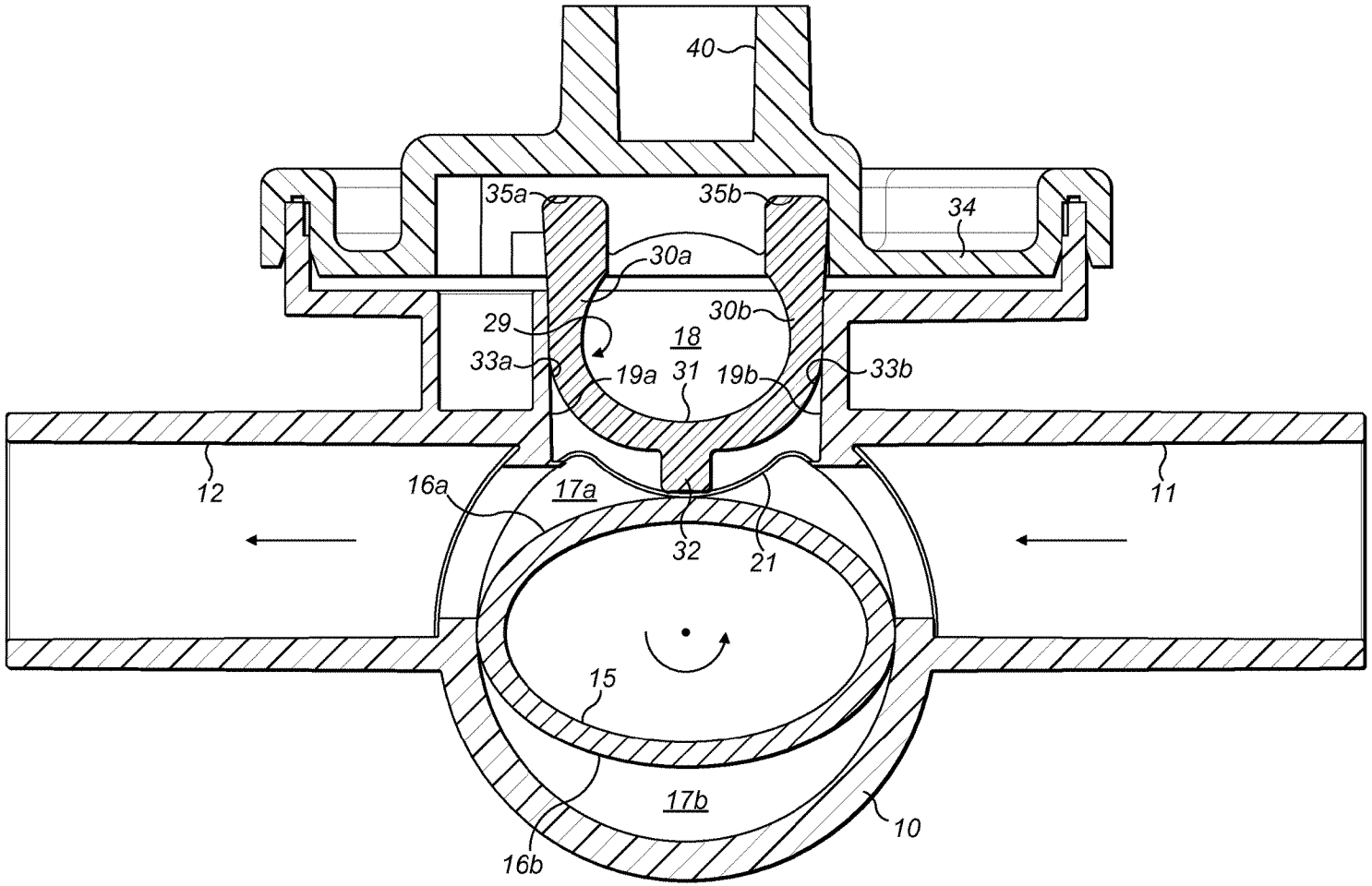
Figure 2B:
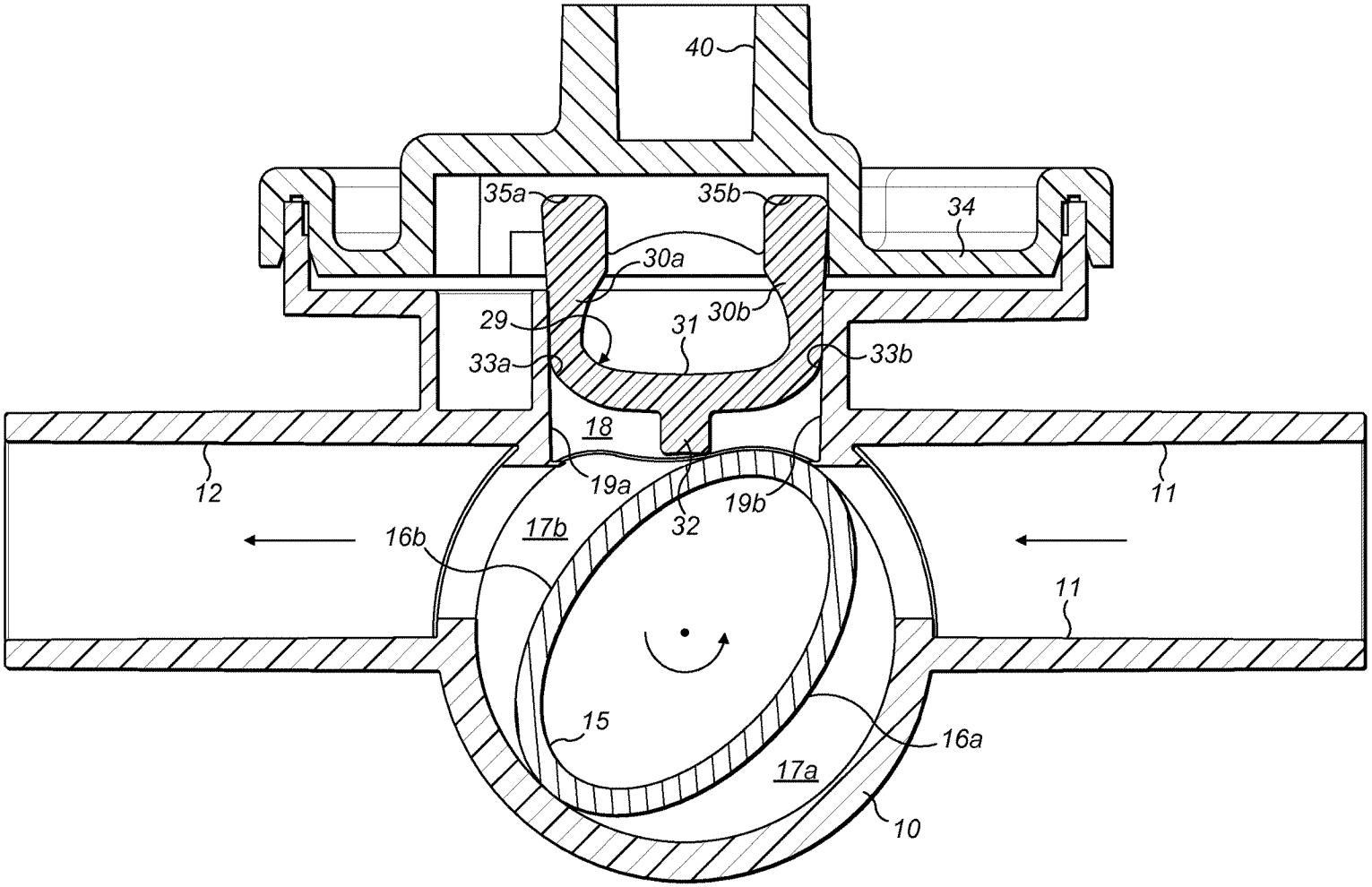
Figure 2C:
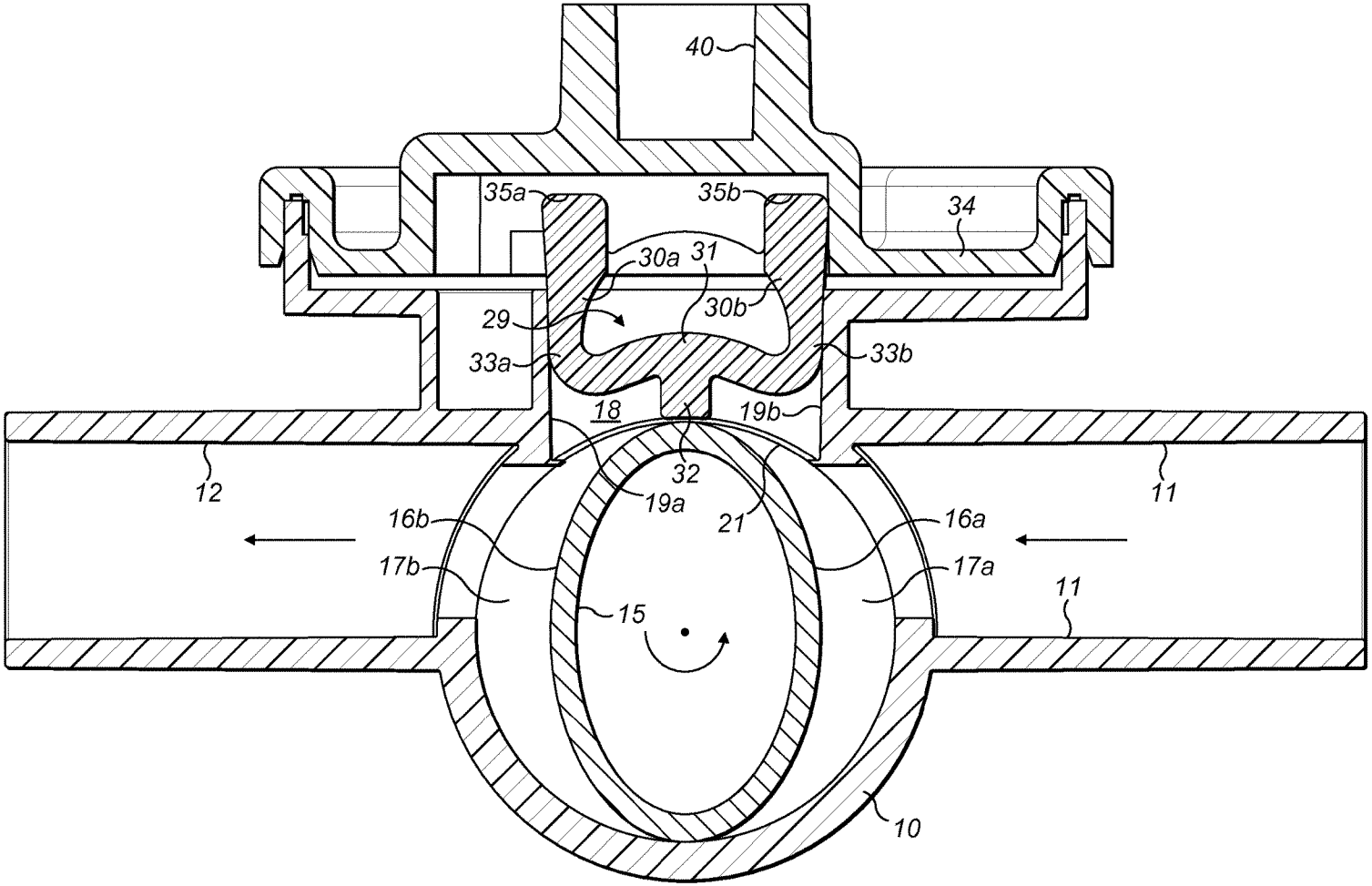
Figure 3:
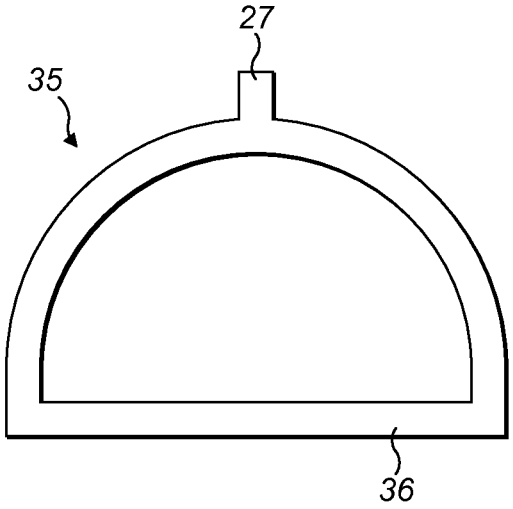
Figure 4:
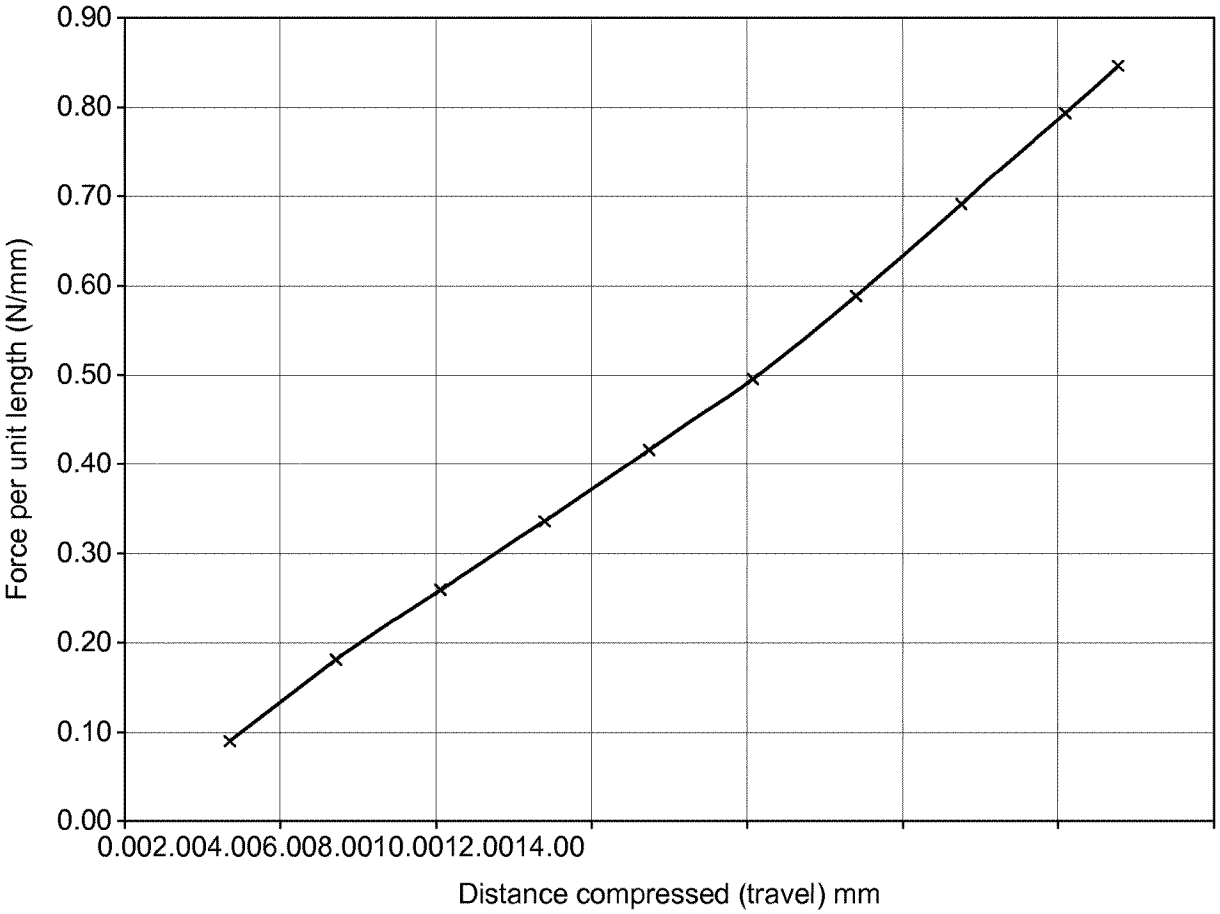
Figure 5:
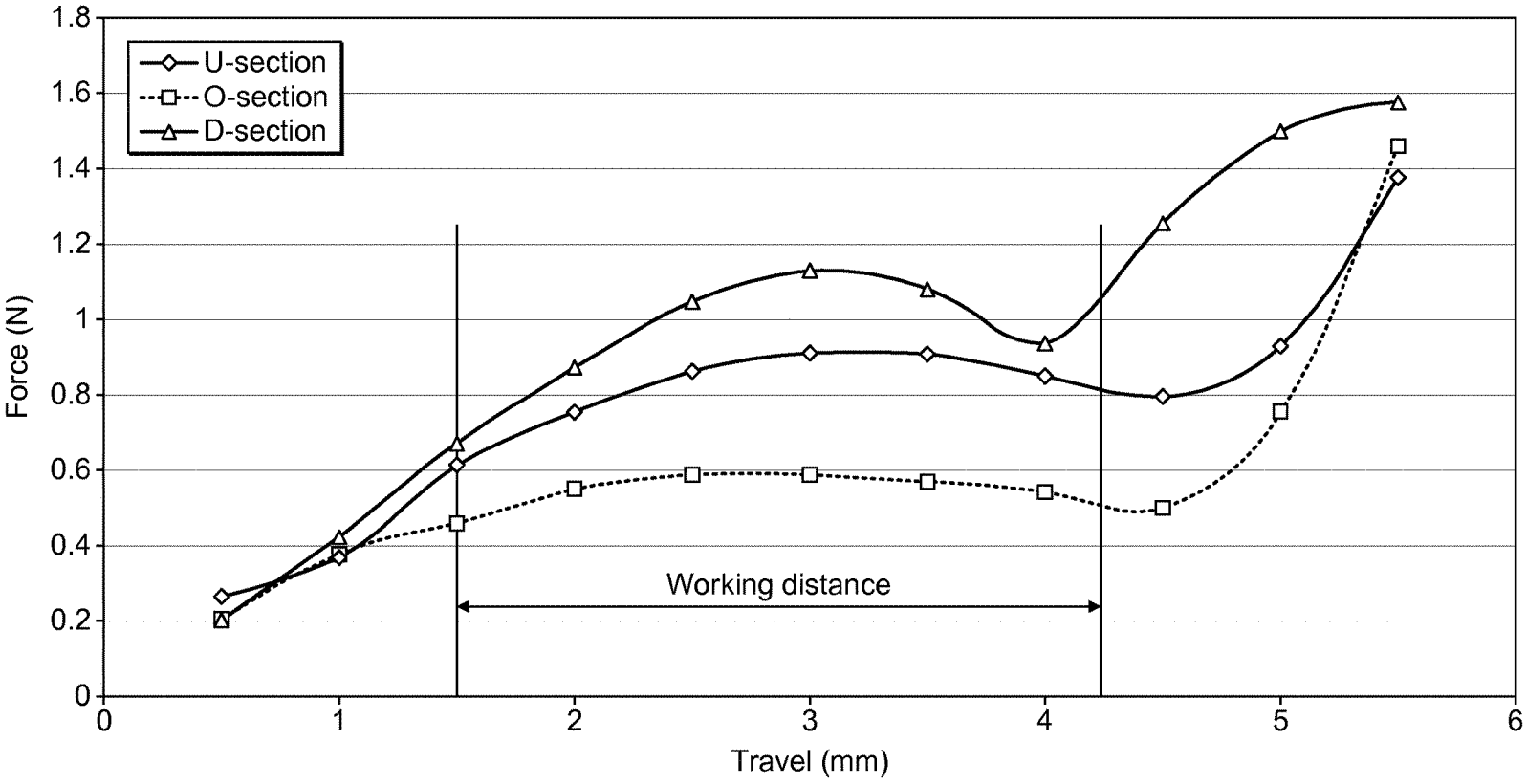
Figure 6:
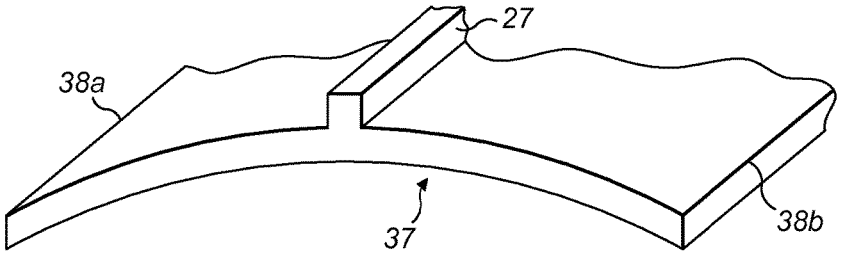
Figure 7:
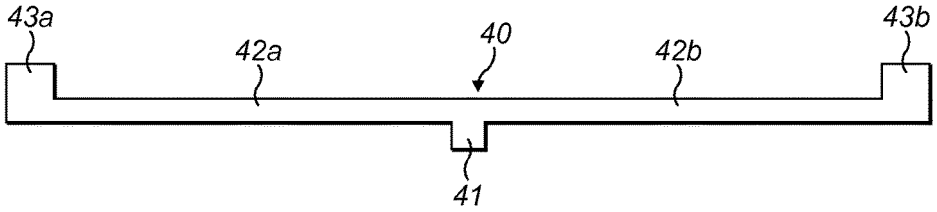

FIG. 1 is a schematic cross-sectional view of a first pump having an inlet and an outlet and a seal assembly including an O-section tubular member arranged between the inlet and the outlet, FIG. 2*a* is a schematic cross-sectional view of a second pump having an inlet and an outlet and a second form of seal assembly including a U-section member arranged between the inlet and the outlet and contacting a rotor, the rotor being in a first angular position, FIG. 2*b* is a similar view to FIG. 2*a* but with the rotor in a second angular position, FIG. 2*c* is a similar view to FIGS. 2*a* and 2*b* but with the rotor in a third angular position, FIG. 3 is a schematic cross-section of a D-section member for use in the seal assembly of the pumps of FIGS. 1 and 2, FIG. 4 is a graph plotting the reactive force exerted by an unrestrained hollow tubular member of flexible resilient material as the member is compressed, the member not being in accordance with the invention, FIG. 5 is a graph plotting reactive force exerted by the tubular members of the seal assemblies of FIG. 1 (□), FIG. 2 (◇) and FIG. 3 (Δ) as the restrained member is compressed, FIG. 6 is a schematic view of an alternative form of member and, FIG. 7 is a cross-section of a further form of member as a flat extrusion.

Referring first to FIG. 1, the first pump is formed by a housing indicated generally at 10 which may be formed by a plastics moulding of, for example, polyethylene or polypropylene. The housing 10 is formed with an inlet 11 for connection to a source of fluid and an outlet 12 for pumped fluid. The interior of the housing 10 is cylindrical. The portion of the interior of the housing 10 between the outlet 12 and the inlet 11, in a clockwise direction as viewed in FIG. 1, carries a seal assembly 14 that will be described in more detail below.

The housing 10 contains a rotor 15. The rotor 15 may be formed of corrosion resistant metal or as a precision injection moulded plastics part formed from a resin such as acetyl. The rotor 15 is shaped as described in PCT/GB05/003300 or PCT/GB10/000798 with recessed surfaces 16*a*, 16*b* that form chambers 17*a*, 17*b* with the housing 10.

The rotor 15 is rotated in a clockwise direction in FIG. 1 by a drive (not shown in the Figures).

The housing 10 is formed between the inlet 11 and the outlet 12 with a seal retainer 18. The seal retainer 18 has parallel spaced side walls 19*a*, 19*b* leading from an opening 20 in the housing 10. Each side wall 19*a*, 19*b* extends parallel to the axis of the rotor 15 and has an axial length that is at least as long as the axial length of the surfaces 16*aa*, 16*b*. End walls (not shown) interconnect the axial ends of the side walls 19*a*, 19*b*. The seal assembly 14 includes a flexible membrane 21 that closes the opening as described in PCT/GB05/003300 or PCT/GB10/000798.

The seal assembly 14 includes a spring member that, in this embodiment, is in the form of an O-section tube 22 that is located in the retainer 18 and is formed from an elastomeric material that is compliant, flexible and resilient such as silicone rubber. When uncompressed, the tube 20 is of hollow circular cross-section formed on an exterior surface 23 with diametrically opposed first and second ribs 24*a*, 24*b* that extend along the exterior surface in respective directions parallel to the axis 25 of the tube 22. The first rib 24*a* bears against the under surface of the membrane 21 as seen in FIG. 1 to seal the membrane 21 against the rotor 15 as the rotor rotates.

The tube 22 and the retainer 18 are dimensioned so that the diameter of the tube 22 is equal or greater than the distance between the side walls 19*a*, 19*b* so that, when the tube 22 is in the retainer 18, the tube 22 presses against the side walls 19*a*, 19*b* to hold the contacting portions of the tube 22 against movement relative to the walls 19*a*, 19*b*. In addition, the retainer 18 is closed by a cap 25 that includes a channel 26 that receives the second rib 24*b* to locate the tube 22 relative to the housing 10 and hold it against rotation. In addition, the cap 25 compresses the tube 22. There is thus a portion 27 of the tube 22 carrying the first rib 24*a* and having opposite ends 28*a*, 28*b* that are in contact with and fixed relative to the two side walls 19*a*, 19*b* and carrying the rib 24*a*. The compression of the tube 22 by the cap 25 flexes this portion 27 radially inwardly relative to the axis of the tube 22.

The operation of the pump described above with reference to FIG. 1 is as described in PCT/GB05/003300 or PCT/GB10/000798. The inlet 11 is connected to a source of fluid to be pumped and the outlet 12 is connected to a destination for the pumped fluid. The rotor 15 is rotated by a drive, such a motor (not shown) in a clockwise direction as viewed in FIG. 1. The chambers 17*a*, 17*b* convey fluid from the inlet 11 to the outlet 12 as described in PCT/GB05/003300 or PCT/GB10/000798 to deliver the fluid to the outlet 12 at an outlet pressure determined by the inlet pressure, the characteristics of the fluid being pumped and the speed of the rotor 15.

As the rotor 15 rotates, the tube 22, via the first rib 24*a*, urges the membrane 21 against the surface of the rotor 15 to prevent the leakage of fluid from the outlet 12 to the inlet 11 again as described in PCT/GB05/003300 or PCT/GB10/000798. During this rotation, the rib 24*a* will move radially relative to the axis of the rotor 15 between a maximum radial spacing (top dead centre or "TDC") and a minimum radial spacing (bottom dead centre or "BDC"). The compression of the tube 22 provided by the cap 25 is chosen so that at BDC the tube 22 applies to the membrane a force just sufficient to ensure that, at BDC, there is no leakage between the membrane 21 and the rotor 15.

On rotation of the rotor 15 from this BDC position, membrane 21 contacts a portion of the rotor 15 that is spaced further from the axis of the rotor 15. The rib 24*a* is thus forced radially outwardly but, since the tube 22 is confined between the walls 19*a*, 19*b*, the tube 22 cannot adapt to this increased force by assuming an oval shape or by compressing the whole tube radially because of the frictional contact between the tube 22 and the side walls 19*a*, 19*b* that keeps the ends 28*a*, 28*b* of the portion 27 fixed relative to the side walls 19*a*, 19*b*. Instead, this portion 27 of the tube 22 flexes inwardly between the points of contact between the tube 22 and the walls 19*a*, 19*b*. This flexing continues until the TDC is reached. At TDC, the inward flexing of the portion 27 is a maximum and, as seen in FIG. 1, the portion 27 is inverted (i.e. its interior surface is convex and not concave). The presence of the rib 24*a* concentrates the force from the rotor 15 and assists this inversion.

This flexing does not change, or does not substantially change, the force applied by the rib 24*a* to the membrane 21 and thus the force applied by the membrane 21 to the rotor 15 since the compression of the tube 22 is prevented from concentrating at the sides of the tube 22 contacting the walls 19*a*, 19*b*. The compression is thus distributed more evenly over the entire section of the tube 22. This has the additional advantage that the tube 22 is less highly stressed than would be the case if the walls 19*a*, 19*b* were not present so reducing any tendency of the tube 22 to deform permanently. This force thus remains at or close to the minimum force required to maintain a seal for the given output pressure of the pumped fluid. This will be discussed in more detail below. This reduces the torque required from the drive, reduces wear on the parts and increases the accuracy of control of flow rates.

The tube 22 described above with reference to FIG. 1 is of constant circular cross-section along its length when unstressed. This need not be the case. The cross-section could be of any convenient shape and need not be constant along the length of the tube 22. For example, for certain cross-sections of rotor, it may be advisable for the tube to have a smaller diameter at its ends and a greater diameter at its centre. The wall thickness of the tube 22 may also vary along its length.

Referring next to FIGS. 2, 2*b* and 2*c*, the second pump has parts in common with the pump of FIG. 1. These parts will be given the same reference numerals in both Figures and will not be described in detail. In the pump of FIGS. 2*a*, 2*b* and 2*c*, the tube 22 of FIG. 1 is replaced by a spring member in the form of an elongate member 29 of inverted U-shape cross-section. The member 29 is formed of the same material as the tube 22 of FIG. 1.

The member 29 has spaced arms 30*a*, 30*b* interconnected by a base portion 31 carrying a rib 32 on its exterior surface. The rib 32 extends parallel to the longitudinal axis of the member 29. The free ends of the spaced arms 30*a*, 30*b* are thickened to ensure the arms 30*a*, 30*b* do not collapse or bend in an uncontrolled manner The member 29 is inverted in the retainer 18 with the outer side faces of the arms 30*a*, 30*b* pressing against the side walls 19*a*, 19*b* so that the ends 33*a*, 33*b* of the base portion are fixed relative to the side walls 19*a*, 19*b*. The rib 32 bears against the under surface of the membrane 21. The retainer 18 is closed by a cap 34 that includes parallel spaced channels 35*a* 35*b* that receive respective free ends of the arms 30*a*, 30*b* to locate the member 29 relative to the housing 10. The cap 34 compresses the member 29 so that the rib 32 is forced against the membrane 21.

The pump of FIGS. 2*a*, 2*b* and 2*c* operates broadly as described above with reference to FIG. 1. At BDC, as shown in FIG. 2*a*, the base portion 31 is slightly flexed so that it applies to the rotor 15 via the membrane 21 just sufficient force to form a seal between the membrane 21 and the rotor 15 to prevent the passage of fluid from the outlet 12 to the inlet 11. On continued rotation of the rotor 15 by about 45°, as seen in FIG. 2*b*, the rotor 15 forces the base portion 31 inwardly. This is accommodated by the base portion 31 reducing its curvature, as compared to the FIG. 2*a* position, which, in turn forces the arms 30*a*, 30 against the side walls 19*a*, 19*b* without compression of the arms 30*a*, 30*b*. Further rotation of the rotor 15, by 90° from the position shown in FIG. 2*a*, is shown in FIG. 2*c*. The rotor 15 forces the base portion to TDC and this is accommodated by the base portion of the member 29 inverting, as seen in FIG. 2*c*. This again does not result in any compression of the arms 30*a*, 30*b*. Indeed, in the act of inverting, the force applied by the member 29 to the rotor 15 may reduce. As with the portion 29 of FIG. 1, this flexing does not therefore change, or does not substantially change, the force applied by the rib 32 to the membrane 21 and thus the force applied by the membrane 21 to the rotor 15 since the change in profile from a pre-loaded circular form to an inverted form requires very little additional force. This will be discussed in more detail below.

An advantage of the U-section member 29 is that it allows quicker recovery of member 29 on flexing as compared to the tube 22 of FIG. 1. This is because, in use, the retainer 18 will be filled either with air or a liquid being pumped or a mixture of both. In the case of the tube 22, this will fill the tube 22 and, as the tube 22 flexes, the fluid in the tube 22 will have to be expelled and then drawn in. the rate at which this can be achieved will affect the maximum rotational speed of the rotor since, if the tube 22 cannot expel such fluid quickly enough, the tube 22 will not be able to flex and so it will obstruct the rotor 15.

This can to an extent be alleviated by forming the retainer 18 or the cap 25 with a hole through which the fluid can pass as the member 22 flexes but the tubular shape of the member 22 itself introduces some lag in the expulsion of the fluid. The U-section member 29 of FIG. 2 mitigates this problem since the space between the arms 30*a*, 30*b* provides a large area passage for the expulsion of fluid from between the arms 30*a*, 30*b*. In addition, a blind hole 40 is formed in the cap 34 and this may be opened to provide a passage through which the fluid passes as the member 29 flexes so allowing even faster expulsion of the fluid from between the arms 30*a*, 30*b*. In this way, the maximum rotational speed of the pump may be increased.

The O-section tube of FIG. 1 or the U-section member 29 of FIGS. 2, 2*b* and 2*c* could be replaced by the D-section member 35 of FIG. 3. This operates as the O-section tube of FIG. 1 with the flat (when unstressed) part 36 of the member 35 acting in the same way as the portion 27 of the O-section tube 22.

FIG. 4 shows the results of compressing a regular tube not in accordance with the invention and FIG. 5 shows the results of compressing the members 22, 29 and 36 of FIGS. 1, 2*a*, 2*b*, 2*c* and 3 respectively. In FIG. 4, a tube of hollow circular cross-section made of a flexible resilient material is compressed. The reactive force exerted by the tube is plotted against the distance by which the tube is compressed. As seen in FIG. 4, the relationship between force and distance is substantially linear and independent of the wall thickness and tube diameter. The tube of FIG. 4 will have to operate from a point on the line of FIG. 4 at which, when the tube is at BDC, the force between the seal 14 and the rotor 15 is just sufficient to maintain the seal for a given fluid pressure at the outlet 12. As the tube moves to TDC, this force will increase linearly and so, at TDC, the force will greatly exceed the force need to maintain the seal since that force does not change, or does not change significantly, with the rotational position of the rotor 15. This will, therefore, increase unnecessarily the frictional force on the rotor 15. In FIG. 5, the members 22, 29, 36 of FIGS. 1, 2*a*, 2*b*, 2*c* and 3 are compressed in the same way and the reactive force measured. The results are plotted in FIG. 5 with the results for the O-section member 22 of FIG. 1 plotted with the symbol □, the U-section member 29 of FIG. 2 with the symbol ◇ and the D-section member 36 of FIG. 3 with the symbol Δ.

It will be seen that, in all cases in FIG. 5, the reactive force rises steeply as the member 22, 29, 36 is compressed and then there is a relatively flat central section in which the rate of change of the force reduces with distance before a further steep rise. Thus, the force applied by the seal 14 per unit distance of travel is less intermediate the limits of travel than towards these limits. The central section of reduced rate of change arises because the inward movement of the portions 27, 31, 36 is not accommodated by the compressive reflexing of the whole member 22, 29, 36 in a radial direction, as is the case with the tube of FIG. 4. Instead, the portion 22, 29, 36 itself flexes with the compressive forces being lateral forces that are taken by the walls 19*a*, 19*b*. As seen in FIG. 5, the force may reduce on compression and this may happen at the point the portion 27, 31, 36 inverts Accordingly, if, in the embodiments of FIGS. 1, 2*a*, 2*b*, 2*c* and 3 the required travel of the rib 24*a*, 32 is in the relatively flat portion of each of the graphs of FIG. 5, the reactive force applied by the member 22, 29, 36 to the rotor 15 is constant across the range of movement of the member 22, 29, 36 in the sense that the force does not vary by more than ±10% across the range. This range for the O-section tube 22 of FIG. 1 is indicated as the "working distance on FIG. 5. It will be appreciated that the "working distance" for the U-section and D-section members 29, 36 is shorter. For the U-section member 29, and as seen from the graph of FIG. 5, the working distance will be about 2.5 mm-from 2.25 mm to 4.75 mm. The members 22, 29, 36 are configured so that the force applied at BDC is the force required to just maintain a seal at BDC. This force does not change, or does not change significantly, as the member 22, 29, 36 moves to TDC and so the frictional forces remain unchanged, or substantially unchanged, at the required minimum level between BDC and TDC. This reduces the power required from the drive and allows more accurate speed control. It reduces the heat generated and reduces wear, so increasing the life of the pump.

It will be appreciated that the recessed surfaces 16*a*, 16*b* have a profile that varies in a direction parallel to the axis of the rotor 15. Since the members 22, 29, 36 have an axial length that is at least as long as the axial length of the surfaces 16*a*, 16*b*, the flexure of the members 22, 29, 36 will vary along their axial length. At the axially spaced ends of the members 22, 29, 26, the members 22, 29, 36 will always be compressed by a maximum amount since, at these ends, they will effectively contact the cylindrical surface of the rotor 15 axially beyond the ends of the surfaces 16*a*, 16*b*. Intermediate these ends, the members 22, 29, 36 will flex between a minimum pre-load amount at BDC and a maximum at TDC.

Since the members 22, 29, 36 apply a force to the rotor 15 that is constant between maximum flexing and minimum flexing, the force applied to the rotor 15 along the axial length of the rotor 15 will also be constant (as defined above) along the axial length of the rotor 15 during rotation at, or close to, the minimum force required to maintain a seal at a given outlet pressure.

Other configurations for the spring member are possible. For example, the member could be formed by an elongate arcuate strip 37 as seen in FIG. 6. The strip 37 has spaced side edges 38*a*, 38*b* that are fixed relative to the side walls 19*a*,19*b* described above with reference to FIGS. 1 and 2*a*, 2*b* and 2*c*. This fixing could be by gluing or by the use of slots on the side walls 19*a*, 19*b* that receive respective side edges of the strip 37. A further embodiment of the seal 14 includes an extruded strip 40, as seen in FIG. 7. The strip 40 is flat with a central rib 41 and portions 42*a*, 42*b* to either side of the rib 41. The free end of each portion 42*a*, 42*b* is formed with a flange 43*a*, 43*b* projecting in a direction opposite to the direction of projection of the rib 41. In use, the strip is formed into a U-section member the same as the U-shaped member 29 described above with reference to FIGS. 2*a*, 2*b* and 2*c*. The member 40 is inserted into the retainer 18 in the same way as the member 29 of FIGS. 2*a*, 2*b* and 2*c* and functions in the same way.

Other forms of non-linear spring may be used that give similar force/distance characteristics to reduce the force applied to the rotor 15 by the spring 14.

Although the rib 24*a*, 32, 41 is shown as formed on the member 22, 29, 36, 40 it could be formed on the membrane 21. The rib 24*a*, 32, 41 is shown in the Figures as a continuous rectangular cross-section member. This need not be the case. It could be of any suitable configuration. The membrane 21 could be omitted and the rib 24*a*, 32, 41 bear against and seal directly with the rotor 15 so that the spring member 22, 29, 36, 40 forms the whole of the seal assembly 14.

Of course, aside from the seal 14, the structure of the pumps described above may be varied in any of the ways described in PCT/GB05/00330 or PCT/GB10/000798.

The invention claimed is:

1. A pump, comprising:

a housing having a fluid inlet and a fluid outlet, the housing containing a rotor having chamber-forming surfaces that are radially inward of the housing, the chamber-forming surfaces forming chambers with the housing such that, on rotation of the rotor about an axis, the chambers convey fluid from the fluid inlet to the fluid outlet to pump the fluid to the fluid outlet at an outlet pressure: and a seal assembly comprising a seal and being arranged between the fluid outlet and the fluid inlet such that, on rotation of the rotor, the seal moves radially inward and outward relative to the axis of rotation of the rotor to maintain contact with the chamber-forming surfaces of the rotor and apply a sealing force along an axial length of the rotor to prevent the fluid passing from the fluid outlet to the fluid inlet in the direction of rotation of the rotor, and wherein the seal assembly includes a spring member of flexible resilient material that generates the scaling force, wherein the spring member has respective opposite side edges that are fixed relative to the housing and extend generally parallel to the rotation axis of the rotor, wherein the spring member applies the sealing force to the rotor between the opposite side edges and flexes resiliently between the opposite side edges as the rotor rotates, wherein the spring member is formed as a hollow tube, a generally U-section member, or another arcuate member, or a member conformable into a U-section member, and wherein the seal assembly is configured to apply a force per unit distance of movement that does not vary by more than plus or minus ten percent throughout travel of the seal assembly to minimise the scaling force applied by the seal assembly to the rotor for a given output pressure.

2. The pump according to claim 1, wherein said sealing force is generally constant along an axial length of contact between the rotor and said seal assembly.

3. The pump according to claim 1, wherein said sealing force does not vary by more than plus or minus ten percent at all angular positions of the rotor.

4. The pump according to claim 1, wherein the spring member is located in a retainer included in the housing, and wherein the spring member is flexed within the retainer and contacts the retainer along said opposite side edges to fix said opposite side edges relative to the housing.

5. The pump according to claim 1, wherein the spring member is the hollow tube located in a retainer included in the housing, wherein the hollow tube and the retainer are dimensioned so that the retainer compresses the hollow tube to flex the hollow tube so that the hollow tube contacts the retainer along the opposite side edges to fix said opposite side edges relative to the housing, and wherein an arcuate portion of the hollow tube between said opposite side edges flexes to apply said sealing force to the rotor.

6. The pump according to claim 1, wherein the spring member is the hollow tube having a D-shaped cross-section.

7. The pump according to claim 1, wherein the generally U-section member has spaced arms interconnected by a base portion, wherein the generally U-section member is inserted in a retainer so that the spaced arms are urged against the retainer to fix said opposite side edges of the generally U-section member relative to the retainer, and wherein the base portion of the generally U-section member between said opposite side edges flexes to apply said sealing force to the rotor.

8. The pump according to claim 1, wherein the spring member is the another arcuate member.

9. The pump according to claim 8, wherein the arcuate member has said opposite side edges that are fixed to a retainer included in the housing.

10. The pump according to claim 1, wherein the seal assembly includes a membrane contacted by the rotor, and wherein the spring member urges the membrane into contact with the rotor.

11. The pump according to claim 10, wherein the spring member carries a rib extending along the spring member in a direction parallel to the axis of the rotor, and wherein the rib contacts the membrane to urge the membrane against the rotor.

12. The pump according to claim 1, wherein the hollow tube has a circular cross-section.

13. The pump according to claim 12, wherein an area of the circular cross-section of the hollow tube is constant along an axial length of the hollow tube.

14. The pump according to claim 1, wherein an area of a cross-section of the hollow tube is constant along an axial length of the hollow tube.

* * * * *